US005860048A

United States Patent [19]

Bonanno

[11] Patent Number: 5,860,048

[45] Date of Patent: Jan. 12, 1999

[54] TONER STIRRER FOR TONER CARTRIDGE OF DEVELOPER HOPPER

[75] Inventor: Vince Bonanno, Roebling, N.J.

[73] Assignee: Oki America, Inc., Hackensack, N.J.

[21] Appl. No.: 995,045

[22] Filed: Nov. 3, 1997

Related U.S. Application Data

[60] Provisional application No. 60/051,707 Jul. 3, 1997.

[51] Int. Cl.[6] ..... G03G 15/08

[52] U.S. Cl. ..... 399/263; 366/325.94; 399/256

[58] Field of Search ..... 399/254, 256, 399/262, 263; 366/325.94, 325.7

[56] References Cited

U.S. PATENT DOCUMENTS

| | | | |
|---|---|---|---|
| 917,921 | 4/1909 | Bowman | 366/325.94 X |
| 1,114,807 | 10/1914 | Ritter | 366/325.94 |
| 4,423,962 | 1/1984 | Knott . | |
| 4,456,364 | 6/1984 | Hatzis . | |
| 4,477,173 | 10/1984 | Kozuka et al. . | |
| 4,583,342 | 4/1986 | Shimono et al. . | |
| 4,755,847 | 7/1988 | Matsushiro et al. . | |
| 4,835,565 | 5/1989 | Nagatsuna et al. . | |
| 4,914,481 | 4/1990 | Yoshikai et al. . | |
| 4,956,675 | 9/1990 | Joseph | 399/254 |
| 4,974,023 | 11/1990 | Aimoto et al. . | |
| 4,977,428 | 12/1990 | Sakakura et al. . | |
| 5,009,187 | 4/1991 | Asanuma et al. . | |
| 5,017,966 | 5/1991 | Suga . | |
| 5,134,441 | 7/1992 | Nagata et al. . | |
| 5,188,057 | 2/1993 | Ishikawa et al. . | |
| 5,235,389 | 8/1993 | Kikuchi et al. . | |
| 5,239,346 | 8/1993 | Corbin et al. . | |
| 5,243,389 | 9/1993 | Yamane et al. . | |
| 5,264,900 | 11/1993 | Momiyama et al. . | |
| 5,264,901 | 11/1993 | Rossiter . | |
| 5,296,900 | 3/1994 | Saijo et al. . | |
| 5,298,952 | 3/1994 | Kamijo et al. . | |
| 5,331,378 | 7/1994 | Baker et al. . | |
| 5,331,388 | 7/1994 | Marotta et al. . | |
| 5,337,032 | 8/1994 | Baker et al. . | |
| 5,345,297 | 9/1994 | Katakabe et al. . | |
| 5,398,106 | 3/1995 | Eguchi . | |
| 5,424,816 | 6/1995 | Fox et al. . | |
| 5,428,427 | 6/1995 | Lee . | |
| 5,465,140 | 11/1995 | Nakamura et al. . | |
| 5,489,976 | 2/1996 | Ichikawa . | |
| 5,506,665 | 4/1996 | Ishida et al. . | |
| 5,548,384 | 8/1996 | Weed . | |
| 5,568,237 | 10/1996 | Ishida et al. . | |
| 5,572,301 | 11/1996 | Shiratori . | |
| 5,581,337 | 12/1996 | Suzuki . | |

*Primary Examiner*—S. Lee

*Attorney, Agent, or Firm*—Panitch Schwarze Jacobs & Nadel, P. C.

[57] ABSTRACT

An improved stirrer for being positioned in a toner cartridge or developer hopper of an electrophotographic printer is disclosed. The toner cartridge or developer hopper is a container having toner disposed therein for being supplied from the container to the printer. The container has first and second longitudinal ends, a generally curved interior wall extending therebetween, and a longitudinal axis. The stirrer has a rotatable driven member, first and second stirring arms, and a bridge member. The rotatable driven member is disposed adjacent the first end of the container, and has an axis of rotation generally parallel to the longitudinal axis of the container. The first and second stirring arms are rotatably fixed to the driven member and extend within the container longitudinally from the driven member. Each stirring arm is generally parallel to the axis of rotation of the driven member, contacts at least a portion of the toner while being rotated, and has a distal end adjacent the second end of the container. The bridge member extends between the distal ends of the first and second stirring arms.

26 Claims, 2 Drawing Sheets

TONER STIRRER FOR TONER CARTRIDGE OF DEVELOPER HOPPER

CROSS-REFERENCE TO RELATED APPLICATIONS

This application claims the benefit of U.S. Provisional Application No. 60/051,707, filed Jul. 3, 1997.

FIELD OF THE INVENTION

The present invention relates to a toner stirrer for a toner cartridge or for a developer hopper for an electrophotographic printer, and more particularly to an improved design for such stirrer.

BACKGROUND OF THE INVENTION

In a conventional electrophotographic printer (not shown), a photosensitive device such as a drum or the like (hereinafter "drum") is uniformly electrostatically charged, a light device such as an LED array or a laser selectively emits light onto the drum to form an electrostatic latent image thereon, toner is applied to the electrostatic latent image on the drum to develop the image into a toner image, a transfer charger transfers the toner image from the drum to a printing sheet, and a pair of heat rollers or the like fixes the transferred toner on the printing sheet.

The toner in the printer is typically supplied from either a non-removable developer hopper, or more commonly from a removable self-contained toner cartridge. It is known in the prior art to include within such developer hopper or toner cartridge a rotating toner stirrer to prevent the toner from clumping inside the developer hopper or toner cartridge, and also to ensure that a steady supply of toner is provided from such developer hopper or toner cartridge. It is also known in the prior art to form the main part of the stirrer from stainless steel or the like (hereinafter "stainless steel") in the shape of a straight rod or one or more helical members, among other things. However, such a stainless steel stirrer is relatively expensive in terms of material costs and manufacturing costs.

Oftentimes it is less expensive in terms of material costs and manufacturing costs to construct an object from a polymer rather than from stainless steel. However, such a polymer normally has less rigorous mechanical, tensile, and other properties than stainless steel, with the result that a polymer version of a part cannot perform the same functions as an otherwise identical stainless steel version of the part. As should be evident, then, it is not practical to replace a stainless steel stirrer in an electrophotographic printer with an otherwise identical polymer stirrer. Accordingly, a need exists for an improved stirrer for such printer, where such stirrer can be constructed from an appropriate relatively less expensive polymer, and where such stirrer is less expensive to manufacture. Moreover, a need exists for such stirrer that is as reliable and sturdy as prior art stainless steel stirrers.

BRIEF SUMMARY OF THE INVENTION

The aforementioned needs are satisfied by a stirrer for being positioned in a toner cartridge or developer hopper of an electrophotographic printer. The toner cartridge or developer hopper is a container having toner disposed therein for being supplied from the container to the printer. In either case, the container has first and second longitudinal ends, a generally curved interior wall extending therebetween, and a longitudinal axis.

The stirrer has a rotatable driven member, first and second stirring arms, and a bridge member. The rotatable driven member is disposed adjacent the first end of the container, and has an axis of rotation generally parallel to the longitudinal axis of the container. The first and second stirring arms are rotatably fixed to the driven member and extend within the container longitudinally from the driven member. Each stirring arm is generally parallel to the axis of rotation of the driven member, contacts at least a portion of the toner while being rotated, and has a distal end adjacent the second end of the container. The bridge member extends between the distal ends of the first and second stirring arms.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF THE INVENTION

Figure 7:
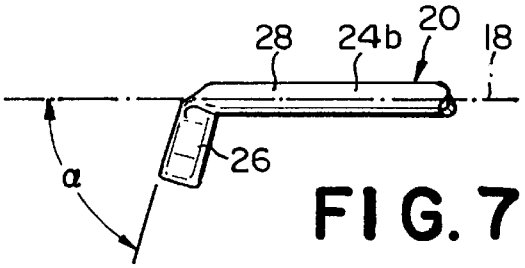
FIGS. 3, 4, 5, and 7 are cross-sectional views taken along the lines 3—3, 4—4, 5—5, and 7—7, respectively, in FIG. 2.

Certain terminology may be used in the following description for convenience only and is not limiting. "Left", "right", "upper" and "lower" designate directions in the drawings to which a reference is made. The words "inwardly" and "outwardly" are further directions toward and away from, respectively, the geometric center of a referenced object. The terminology includes the words above specifically mentioned, derivatives thereof, and words of similar import.

Figure 1:
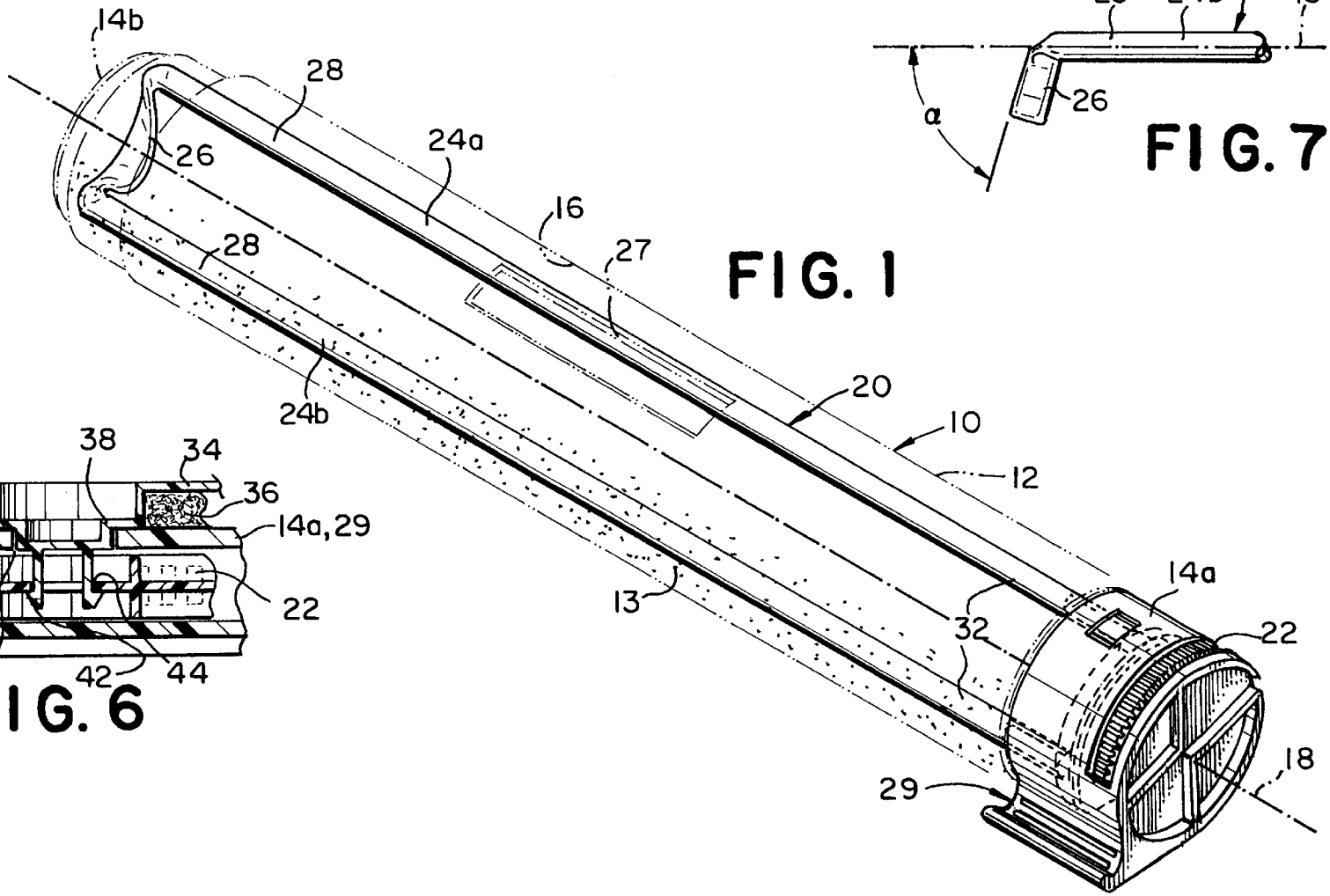
FIG. 1 is a perspective view of a stirrer for a toner cartridge (shown partially in phantom) or for a developer hopper (not shown) for an electrophotographic printer in accordance with a preferred embodiment of the present invention.

Referring to the drawings in detail, wherein like numerals are used to indicate like elements throughout, there is shown in FIG. 1 a stirrer 20 in accordance with a preferred embodiment of the present invention. As seen, the stirrer 20 is positioned onto a toner cartridge 10 (shown partially in phantom) which includes a hollow, generally longitudinal toner storage container 12. The container 12 has toner 13 disposed therein for being supplied from the toner cartridge 10 to a printer (not shown) within which the toner cartridge 10 is properly inserted. As should be understood, the container 12 is specifically designed to be inserted into one or more types of printers, and therefore may be any appropriate container without departing from the spirit and scope of the present invention. As seen in FIG. 1, the container has first and second longitudinal end walls or ends 14*a*, 14*b*, a generally curved interior wall 16 extending between the first and second ends 14*a*, 14*b*, and a generally longitudinal axis 18.

Figure 5:
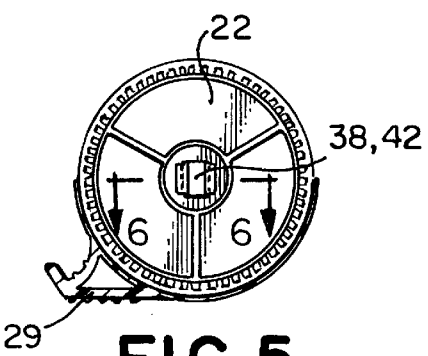
Figure 4:
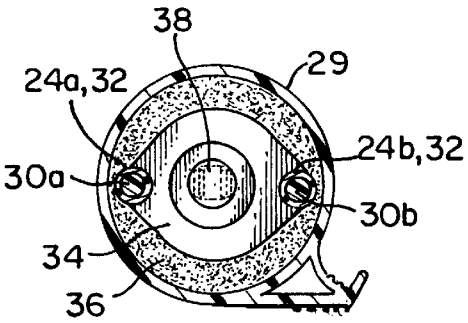

As should be understood, and as was discussed above, the stirrer 20 stirs the toner 13 within the container 12 to prevent the toner 13 from clumping, and also to ensure that the toner 13 moves from the toner cartridge 10 to the printer in an orderly manner. In a preferred embodiment of the present invention, the stirrer 20 includes a rotatable driven member 22 (as best seen in FIGS. 2 and 5), first and second stirring arms 24*a*, 24*b* (as best seen in FIGS. 2, 3, and 4), and a bridge member 26 (as best seen in FIGS. 2 and 3).

Figure 2:
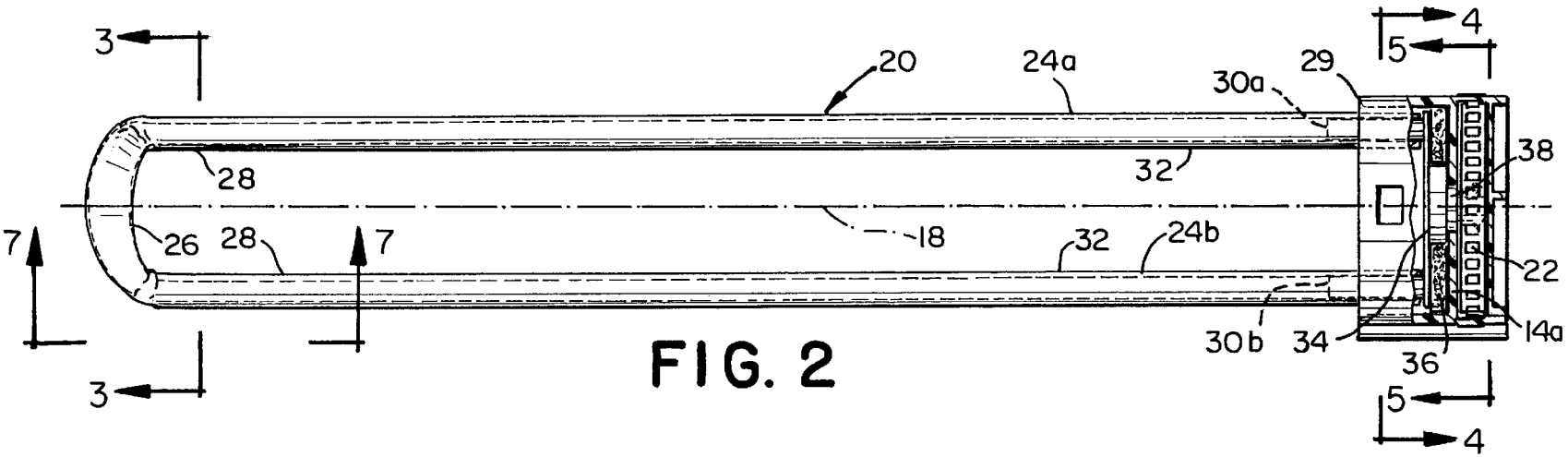
FIG. 2 is a plan view of the stirrer shown in FIG. 1.
Figure 3:
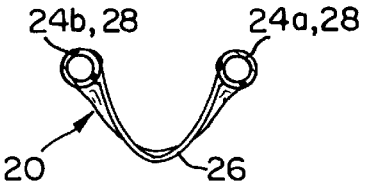

As seen in FIG. 2, the driven member 22 of the stirrer 20 is fitted onto the toner cartridge 10 exterior to and adjacent the first end 14*a* of the container 12, within a side assembly 29, and such side assembly 29 has a window 27 through which the driven member 22 is externally accessible. As shown, the side assembly 29 is attached to and forms the first end 14*a* of the container 12. The driven member 22 has an axis of rotation generally parallel to the longitudinal axis 18 of the container 12. One skilled in the art will recognize that the driven member 22 (and the window 27) may be at alternate positions on the toner cartridge 10 without departing from the spirit and scope of the present invention.

Preferably, and as seen, the driven member 22 is a gear having radially extending teeth, and the window 27 exposes such radial teeth. Accordingly, the driven member 22 shown is to be driven by a driving member (not shown) laterally positioned with respect to the container 12. Such driving member may be a round gear, a worm gear, or the like, and is associated with and controlled by the printer within which the container 12 is located. However, one skilled in the art will recognize that the driving member may be any other appropriate driving member without departing from the spirit and scope of the present invention, and that the driven member 22 may likewise be any other appropriate driven member without departing from the spirit and scope of the present invention. For example, the driven member 22 may be a round gear having axially extending teeth extending outwardly from the toner cartridge 10 (with the window 27 being appropriately positioned), and the driving member may be an appropriate matching device. Preferably, the driven member 22 is formed from a polymer such as an acetal co-polymer or the like.

Referring to FIGS. 1 and 2, the first and second stirring arms 24*a*, 24*b* are rotatably fixed to the driven member 22 and extend within the container 12 longitudinally from the driven member 22 toward the second end 14*b* of the container 12. Each stirring arm 24*a*, 24*b* is generally parallel to the longitudinal axis 18 of the container 12 and therefore also to the axis of rotation of the driven member 22. In addition, each stirring arm 24*a*, 24*b* contacts at least a portion of the toner 13 within the container 12 while the driven member 22 and the first and second stirring arms 24*a*, 24*b* are being rotated, thereby stirring the toner 13 to prevent clumping and to ensure the orderly delivery of the toner 13 from the toner cartridge 10 to the printer through an appropriate toner opening 27 (FIG. 1) in the container 12. Also, each stirring arm 24*a*, 24*b* has a distal end 28 adjacent the second end 14*b* of the container 12. Preferably, the distal ends 28 of the first and second stirring arms 24*a*, 24*b* extend substantially completely toward the second end 14*b* of the container 12, although it will be recognized that the stirring arms 24*a*, 24*b* can extend short of the second end 14*b* of the container 12 without departing from the spirit and scope of the present invention.

Preferably, the first and second stirring arms 24*a*, 24*b* each comprise a hollow tube, as best seen in FIGS. 2, 3, and 4. More preferably, each hollow tube is formed from a polymer such as a polypropylene polymer or the like. Preferably, each polymeric hollow tube has an outer diameter and wall thickness to prevent torsional twisting during rotation thereof within the container 12. For example, assuming the rotation of each stirring arm 24*a*, 24*b* defines a cylinder having a width of about 210 to 230 millimeters and a diameter of about 28 to 32 millimeters, each hollow tube may have an outer diameter of about 4 to 6 millimeters and a wall thickness of about 0.5 to 0.7 millimeters, although one skilled in the art will recognize that other dimensions may be employed, depending upon the application, without departing from the spirit and scope of the present invention.

Referring now to FIGS. 2 and 3, it is seen that the bridge member 26 extends between the distal ends 28 of the first and second stirring arms 24*a*, 24*b*. As should be understood, the bridge member 26 provides additional structural integrity to the stirrer 20, and thereby prevents torsional twisting of the stirring arms 24*a*, 24*b*. Preferably, the bridge member is generally U-shaped and resides in a plane oriented at an angle $\alpha$ (FIG. 7) with respect to the plane within which the first and second stirring arms 24*a*, 24*b* generally reside. Preferably, the angle is between about 50 and 80 degrees, and more preferably, the angle is about 66 degrees. Preferably, and as best seen in FIG. 7, the aforementioned planes intersect at a line generally perpendicular to the first and second stirring arms.

The aforementioned angle $\alpha$ is preferable so that when the stirrer 20 is positioned within the container 12, the bridge member 26 does not obstruct the axial path leading from the second end 14*b* into the container 12. More particularly, the container 12 typically contains an end aperture (not shown) at the second end 14*b* defining the axial path, and toner 13 is poured into the container 12 through the end aperture after the container 12 with the stirrer 20 has been otherwise assembled. Such end aperture is typically sealed with an appropriate end cap (also not shown). If the angle $\alpha$ were to be relatively small or even zero, the bridge member 26 would tend to obstruct the pouring of such toner 13 into the container 12 from an appropriate pouring device (not shown). However, with the angle $\alpha$ being relatively large, the bridge member 26 does not obstruct such pouring, and the pouring device may include a spout or nozzle (not shown) that is inserted within the container through the end aperture and past the bridge member 26.

Preferably, the stirring arms 24*a*, 24*b* do not bow in and thereby miss raking a portion of the toner 13 within the container 12 adjacent the center thereof. Accordingly, the stirring arms 24*a*, 24*b* are preferably formed to be straight or to exhibit a slight bowing out. Of course, one skilled in the art will recognize that other means may be employed to prevent the stirring arms 24*a*, 24*b* from bowing in without departing from the spirit and scope of the present invention. For example, although not believed to be necessary in the present invention, it may be useful to dimension the stirrer 20 such that, when installed within the container 12, the bridge member 26 just contacts the second end 14*b* of the container 12. Accordingly, the second end 14*b* would exert a slight pressure on the bridge member 26, and such pressure would translate to a slight bowing out of the first and second stirring arms 24*a*, 24*b*.

Preferably, the first and second stirring arms 24*a*, 24*b* and the bridge member 26 comprise a single unitary body formed from a hollow tube. More preferably, the hollow tube is a polymer such as the aforementioned polypropylene polymer or the like. Accordingly, a single length of the hollow tube may be selected, cut to length, and then formed by appropriate thermal and mechanical application.

Preferably, the stirrer 20 includes first and second posts 30*a*, 30*b*, as best seen in FIGS. 2 and 4, each of which extends generally longitudinally from the driven member 22 toward the second end 14*b* of the container 12. As seen, the first and second stirring arms 24*a*, 24*b* each have a proximal tube end 32 adjacent the first end 14*a* of the container 12, and the first and second posts 30*a*, 30*b* are securely fitted to and extend into the proximal tube ends 32 of the first and second stirring arms 24*a*, 24*b*, respectively, to secure such stirring arms 24*a*, 24*b* to such driven member 22. Such secure fitting may be achieved by press fitting the first and second stirring arms 24*a*, 24*b* onto the posts 30*a*, 30*b*, respectively, and/or by employing an epoxy or other securing material. However, one skilled in the art will recognize that other securing means may be employed, and that such other securing means may not necessarily require the use of the posts 30*a*, 30*b*, all without departing from the spirit and scope of the present invention.

Preferably, and as best seen in FIG. 4, the first and second posts 30*a*, 30*b*, and therefore the first and second stirring arms 24*a*, 24*b*, are diametrically opposed to each other with respect to the driven member 22. Accordingly, at least one of the stirring arms 24*a*, 24*b* rakes the toner 13 within the container 12 during each half rotation of the driven member 22.

Figure 6:
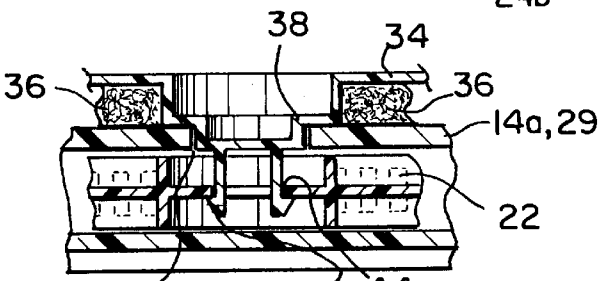
FIG. 6 is a cross-sectional view taken along the line 6—6 in FIG. 5.

Preferably, and as best seen in FIGS. 4 and 6, the stirrer 20 includes a flange member 34 that is generally coaxial with and rotatably fixed to the driven member 22, where the first and second posts 30*a*, 30*b* are attached to and extend directly from the flange member 34, and the flange member 34 is positioned within the container 12 adjacent the first end 14*a* thereof. Preferably, and as seen, a sealing member 36 is interposed between the flange member 34 and the driven member 22 within the container 12 and directly adjacent the first end 14*a* thereof to seal the toner 13 within the container 12 at the first end 14*a* thereof. Preferably, the sealing member 36 is a generally washer-like sealing sponge coaxial with the driven member 22 and the flange member 34 and fitted around a shaft 38 extending directly from the flange member 34 toward the driven member 22.

Preferably, and as seen in FIG. 6, the shaft 38 extends through an appropriate aperture 40 in the first end 14*a* of the container 12, and includes at an outer most portion a connector 42 such as a snap fit member or the like which is securely fitted within an appropriate aperture 44 in the driven member 22 such that the flange member 34 is rotatably fixed to the driven member 22. Preferably, the shaft 38, the flange member 34 and the first and second posts 30*a*, 30*b* comprise a single unitary body formed from a polymer such as an acetal polymer or the like. Accordingly, such single unitary body may be cast from a single mold. However, one skilled in the art will appreciate that other means and methods for forming the flange member 34 and the first and second posts 30*a*, 30*b* may be employed without departing from the spirit and scope of the present invention.

Although the present invention has been described in terms of a stirrer 20 within a toner cartridge 10, one skilled in the art will appreciate that the stirrer 20 may also be positioned on and within a developer hopper (not shown) in a printer (not shown) without departing from the spirit and scope of the present invention. Of course, such a stirrer 20 for such a developer hopper may be slightly different in design, but such design differences are not material to the preferred embodiments of the present invention as described above. For example, the side assembly 29 shown in the drawings may be different or may not be necessary at all. In addition, since in such a printer, toner 13 is typically poured by hand from a toner container directly into the developer hopper, a guiding means for guiding the toner into the hopper may be necessary.

From the foregoing description, it can be seen that the present invention comprises an improved and useful stirrer 20 for being mounted in a toner cartridge or developer hopper in an electrophotographic printer. In particular, all parts of the stirrer 20 are preferably formed from a polymer such that material and manufacturing costs are reduced. Of course, one skilled in the art will recognize that the present invention is not limited to an all-polymer stirrer 20. Instead, the stirrer 20 may in fact contain non-polymer parts while still being within the spirit and scope of the present invention. It will be appreciated by those skilled in the art, then, that changes can be made to the embodiments described above without departing from the broad inventive concepts thereof. It is understood, therefore, that this invention is not limited to the particular embodiments disclosed, but it is intended to cover modifications within the spirit and scope of the present invention as defined by the appended claims.

I claim:

1. A toner cartridge for being mounted in an electrophotographic printer, the toner cartridge comprising:

a hollow generally longitudinally extending container having toner disposed therein for being supplied from the toner cartridge to the printer, the container having first and second longitudinal ends, a generally curved interior wall extending therebetween, and a longitudinal axis; and a stirrer having:

a rotatable driven member disposed adjacent the first end of the container, the driven member having an axis of rotation generally parallel to the longitudinal axis of the container;

first and second stirring arms rotatably fixed to the driven member and extending within the container longitudinally from the driven member, each stirring arm being generally parallel to the axis of rotation of the driven member, contacting at least a portion of the toner while being rotated, and having a distal end adjacent the second end of the container; and a bridge member extending between the distal ends of the first and second stirring arms.

2. The toner cartridge of claim 1 wherein the bridge member is generally U-shaped and resides in a first plane oriented at an angle with respect to a second plane within which the first and second stirring arms generally reside.

3. The toner cartridge of claim 2 wherein the angle is between about 50 and about 80 degrees.

4. The toner cartridge of claim 3 wherein the angle is about 66 degrees.

5. The toner cartridge of claim 2 wherein the first and second planes intersect at a line generally perpendicular to the first and second stirring arms.

6. The toner cartridge of claim 2 wherein the first and second stirring arms and the bridge member comprise a single unitary body formed from a hollow tube.

7. The toner cartridge of claim 1 further comprising a flange member generally coaxial with and rotatably fixed to the driven member, the first and second stirring arms being attached to and extending from the flange member.

8. The toner cartridge of claim 7 further comprising a sealing member interposed between the flange member and the driven member for sealing the toner within the container at the first end thereof.

9. The toner cartridge of claim 1 wherein the first and second stirring arms each comprise a hollow tube.

10. The toner cartridge of claim 9 further comprising first and second posts extending longitudinally from the driven member toward the second end of the container, wherein the first and second stirring arms each have a proximal tube end adjacent the first end of the container, the first and second posts being securely fitted to and extending into the proximal tube ends of the first and second stirring arms, respectively.

11. The toner cartridge of claim 10 further comprising a flange member generally coaxial with and rotatably fixed to the driven member, the first and second posts being attached to and extending from the flange member, wherein the first and second posts and the flange member comprise a single unitary body formed from a polymer.

12. The toner cartridge of claim 10 wherein the first and second posts are diametrically opposed to each other with respect to the driven member.

13. The toner cartridge of claim 1 wherein the driven member is a gear.

14. A stirrer for being mounted in an electrophotographic printer, the stirrer for being positioned within a container having toner disposed therein for being supplied from the container to the printer, the container having first and second longitudinal ends, a generally curved interior wall extending therebetween, and a longitudinal axis, the stirrer comprising:

a rotatable driven member for being disposed adjacent the first end of the container, the driven member having an axis of rotation generally parallel to the longitudinal axis of the container;

first and second stirring arms rotatably fixed to the driven member for extending within the container longitudinally from the driven member, each stirring arm being generally parallel to the axis of rotation of the driven member, contacting at least a portion of the toner while being rotated, and having a distal end adjacent the second end of the container; and a bridge member extending between the distal ends of the first and second stirring arms.

15. The stirrer of claim 14 wherein the bridge member is generally U-shaped and resides in a first plane oriented at an angle with respect to a second plane within which the first and second stirring arms generally reside.

16. The stirrer of claim 15 wherein the angle is between about 50 and about 80 degrees.

17. The stirrer of claim 16 wherein the angle is about 66 degrees.

18. The stirrer of claim 15 wherein the first and second planes intersect at a line generally perpendicular to the first and second stirring arms.

19. The stirrer of claim 15 wherein the first and second stirring arms and the bridge member comprise a single unitary body formed from a hollow tube.

20. The stirrer of claim 14 further comprising a flange member generally coaxial with and rotatably fixed to the driven member, the first and second stirring arms being attached to and extending from the flange member.

21. The stirrer of claim 20 further comprising a sealing member interposed between the flange member and the driven member for sealing the toner within the container at the first end thereof.

22. The stirrer of claim 14 wherein the first and second stirring arms each comprise a hollow tube.

23. The stirrer of claim 22 further comprising first and second posts extending longitudinally from the driven member toward the second end of the container, wherein the first and second stirring arms each have a proximal tube end adjacent the first end of the container, the first and second posts being securely fitted to and extending into the proximal tube ends of the first and second stirring arms, respectively.

24. The stirrer of claim 23 further comprising a flange member generally coaxial with and rotatably fixed to the driven member, the first and second posts being attached to and extending from the flange member, wherein the first and second posts and the flange member comprise a single unitary body formed from a polymer.

25. The stirrer of claim 23 wherein the first and second posts are diametrically opposed to each other with respect to the driven member.

26. The stirrer of claim 14 wherein the driven member is a gear.

* * * * *